US010507502B2

(12) United States Patent
Bolik

(10) Patent No.: US 10,507,502 B2
(45) Date of Patent: Dec. 17, 2019

(54) FORMING MACHINE, PARTICULARLY RING-ROLLING MACHINE

(71) Applicant: SMS group GmbH, Duesseldorf (DE)

(72) Inventor: Ralf Bolik, Moenchengladbach (DE)

(73) Assignee: SMS group GmbH, Duesseldorf (DE)

( * ) Notice: Subject to any disclaimer, the term of this patent is extended or adjusted under 35 U.S.C. 154(b) by 170 days.

(21) Appl. No.: 14/683,223

(22) Filed: Apr. 10, 2015

(65) Prior Publication Data

US 2015/0290689 A1 Oct. 15, 2015

(30) Foreign Application Priority Data

Apr. 11, 2014 (DE) ..... 10 2014 005 332

(51) Int. Cl.

| | |
|---|---|
| ***B21H 1/06*** | (2006.01) |
| ***B21B 35/14*** | (2006.01) |
| ***B21J 9/14*** | (2006.01) |
| ***B21J 9/10*** | (2006.01) |
| ***B21B 35/00*** | (2006.01) |
| ***B21J 9/12*** | (2006.01) |
| ***B21B 1/16*** | (2006.01) |
| ***B21B 31/02*** | (2006.01) |

(52) U.S. Cl.

CPC ..... *B21B 35/14* (2013.01); *B21B 1/16* (2013.01); *B21B 31/02* (2013.01); *B21B 35/00* (2013.01); *B21H 1/06* (2013.01); *B21J 9/10* (2013.01); *B21J 9/12* (2013.01); *B21J 9/14* (2013.01)

(58) Field of Classification Search

CPC ..... B21J 19/14; B21J 9/14; B21J 9/10; B21J 9/12; B21B 35/00; B21B 35/14; B21H 1/06

USPC ..... 72/249

See application file for complete search history.

(56) References Cited

U.S. PATENT DOCUMENTS 3,186,202 A * 6/1965 Ulrych ..... B21H 1/06 72/87
3,698,218 A 10/1972 Wieting
3,839,887 A * 10/1974 Vieregge ..... B21H 1/06 72/11.1

(Continued)

FOREIGN PATENT DOCUMENTS

CN 201442020 U 4/2010
CN 101934291 A 1/2011

(Continued)

OTHER PUBLICATIONS

Siegfried Helduser, "Electrohydraulic System Technology: Key aspects in the development of stationary hydraulics" ("Elektrisch-hydraulische Systemtechnik"), O+P. Oelhydraulik und Pneumatik, Jan. 2006, vol. 50, No. 1, p. 16-23 (with English translation).

(Continued)

*Primary Examiner* — David B Jones
(74) *Attorney, Agent, or Firm* — Collard & Roe, P.C.

(57) ABSTRACT

A forming machine, particularly a ring-rolling machine, which includes a hydraulically regulated linear axle, which is driven by way of an electro-hydrostatic actuator, can work precisely while having a simple mechanical-engineering structure. The machine may have at least one further hydraulically regulated linear axle, which is driven by way of an electro-hydrostatic actuator or by way of a drive other than an electro-hydrostatic actuator.

7 Claims, 1 Drawing Sheet

(56) References Cited

U.S. PATENT DOCUMENTS

| | | | | |
|---|---|---|---|---|
| 7,679,757 | B1 | 3/2010 | Harris et al. | |
| 9,127,936 | B2 | 9/2015 | Freitag et al. | |
| 2013/0067898 | A1* | 3/2013 | Onishi | F15B 15/18 60/325 |
| 2014/0029018 | A1 | 1/2014 | Freitag et al. | |
| 2015/0056315 | A1* | 2/2015 | Pannewtiz | B30B 11/005 425/78 |

FOREIGN PATENT DOCUMENTS

| | | | |
|---|---|---|---|
| CN | 202438643 | U | 9/2012 |
| CN | 103272974 | A | 9/2013 |
| CN | 103328923 | A | 9/2013 |
| DE | 25 04 969 | A1 | 8/1976 |
| DE | 38 24 856 | A1 | 1/1990 |
| DE | 39 21 094 | A1 | 1/1991 |
| DE | 39 23 275 | C2 | 5/1992 |
| DE | 43 12 565 | A1 | 10/1994 |
| DE | 102 31 430 | A1 | 2/2004 |
| DE | 10 2006 057040 | B3 | 5/2008 |
| DE | 10 2010 046 737 | A1 | 3/2012 |
| DE | 10 2011 000 304 | A1 | 7/2012 |
| EP | 1 245 302 | A1 | 10/2002 |
| EP | 1 679 137 | A1 | 7/2006 |
| EP | 2 444 176 | B1 | 10/2012 |
| GB | 2 454 281 | A | 5/2009 |
| JP | S62-010919 | U | 1/1967 |
| JP | S62-010919 | U | 1/1987 |
| JP | S62-101333 | A | 5/1987 |
| JP | S63-112009 | A | 5/1988 |
| JP | H02-133131 | U | 11/1990 |
| JP | H04-182005 | A | 6/1992 |
| JP | H04-210836 | A | 7/1992 |
| JP | H06-153200 | A | 5/1994 |
| JP | H07-083635 | A | 3/1995 |
| JP | H11-156412 | A | 6/1999 |
| JP | H11-285703 | A | 10/1999 |
| JP | 2000-288616 | A | 10/2000 |
| JP | 2002-210503 | A | 7/2002 |
| JP | 2008203091 | A | 9/2008 |
| JP | 2008-246496 | A | 10/2008 |
| JP | 2011-038558 | A | 2/2011 |
| JP | 2015-179021 | A | 10/2015 |
| SU | 668142 | A1 | 6/1985 |
| WO | 2012/101166 | A1 | 8/2012 |
| WO | 2013/041083 | A2 | 3/2013 |

OTHER PUBLICATIONS

European Examination Report in 15162853.4-1702, dated Sep. 28, 2015, with English translation of relevant parts.
German Examination Report dated Jan. 8, 2015 in German Application No. 10 2014 005 332.6 with English translation of the relevant parts.
German Examination Report dated Nov. 11, 2014 in in German Application No. 10 2014 005 333.4 with English translation of the relevant parts.
Relevant Portion of Notification of Provisional Rejection dated May 11, 2016 for Korean Patent Application No. 10-2015-0051007.
Japanese Office Action dated May 10, 2016 in Japanese Application No. 2015-081223.
Siegfried Helduser, "Elektrisch-hydraulische Systemtechnik", O+P. Oelhydraulik und Pneumatik, Jan. 2006, vol. 50, No. 1, p. 16-23.
European Search Report dated Sep. 25, 2015 in European Application No. 15 162 656.1 with English translation of the relevant parts.
"TBK Measuring Equipment—Contactless measurements for optimal production processes," TBK automatization and mess technique, Mar. 2014 (Mar. 2014), SMS group, Found in internet: URL:http://meer.sms-group.com/fileadmin/user_upload/pdf/publicationgroup/langprodukte/profil/TBK DE 03-14.pdf, [found on Sep. 11, 2015], total of 20 pages.
Japanese Office Action in JP 2015-081224, dated May 10, 2016.
Relevant parts of Korean Office Action in KR 10-2015-0050585, dated Apr. 20, 2016.
English Translation (from German translation) of Chinese Office Action in CN 201510173351.7, dated Jul. 21, 2016.
Wikipedia entry for "Light section", downloaded on May 16, 2017 from https://en.wikipedia.org/wiki/Light_section.
Machine translation of DE3923275, Noll et al., pp. 1-9, translated on Mar. 27, 2017.
Relevant parts of Korean Office Action in KR 10-2015-0051007, dated Apr. 17, 2017.
Relevant parts of Korean Office Action in KR 10-2017-0018540, dated Apr. 17, 2017.
Second Chinese Office Action in CN 201510173075.4 dated Sep. 3, 2018.
Third Office Action in Chinese Patent Application 201510173075.4, dated Apr. 9, 2019.
Peng Wang et al., Research of Linear Electric Cylinder with Hydraulic Booster, Chinese Hydraulics and Pneumatics, May 28, 2008, pp. 50-51 (Relevance set forth in Apr. 9, 2018 Third Office Action in Chinese Patent Application 201510173075.4).
"Electro-hydraulic actuator", Retrieved from https://en.wikipedia.org/w/index.php?title=Electro-hydraulic_actuator&oldid=866504715, last edited Oct. 30, 2018.

* cited by examiner

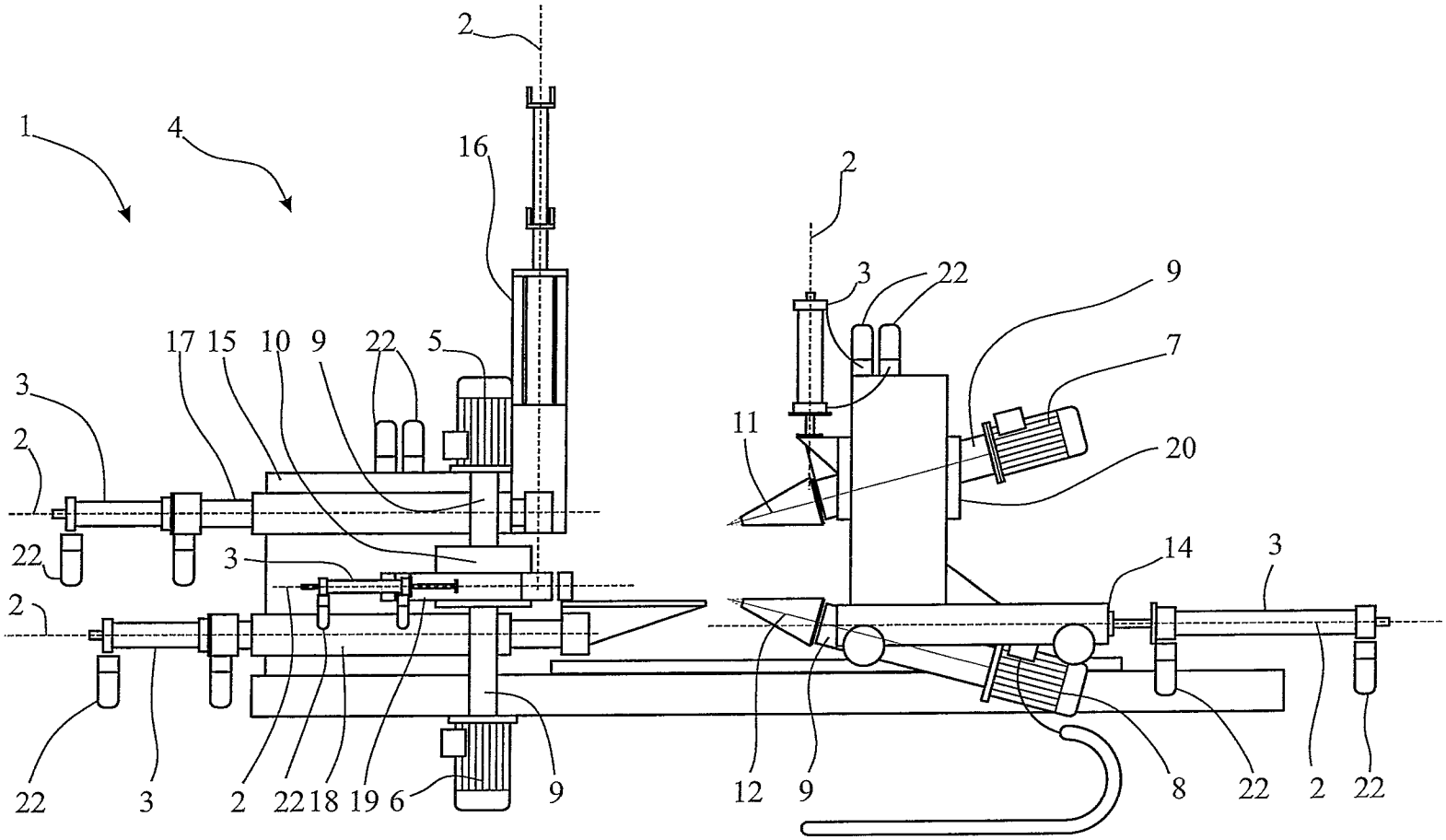
1
2
3
4
5
6
7
8
9
10
11
12
14
15
16
17
18
19
20
22

FORMING MACHINE, PARTICULARLY RING-ROLLING MACHINE

CROSS REFERENCE TO RELATED APPLICATIONS

Applicant claims priority under 35 U.S.C. § 119 of German Application No. 10 2014 005 332.6 filed Apr. 11, 2014, the disclosure of which is incorporated by reference.

BACKGROUND OF THE INVENTION

1. Field of the Invention

The invention relates to a forming machine, particularly to a ring-rolling machine. In particular, the invention relates to a ring-rolling machine having at least one hydraulically regulated linear axle. Likewise, the invention also relates to corresponding forming machines. Furthermore, the invention also relates to a method for control of a ring-rolling machine.

2. Description of the Related Art

Such ring-rolling machines and control methods are sufficiently known from the state of the art, for example from DE 25 04 969 A1, from DE 38 24 856 A1, from EP 2 444 176 B1 or from DE 39 21 094 A1. In this connection, the ring-rolling machines regularly comprise a radial drive that is connected to interact with a roll shaft of a radial rolling roller that acts in the radial direction, and at least one axial drive that is connected to interact with a roll shaft of an axial rolling roller that acts in the axial direction. In this connection, as shown, for example, in DE 25 04 969 A1, DE 38 24 856 A1, EP 2 444 176 B1 or also in DE 39 21 094 A1, the axial rollers generally serve for axially forming a workpiece to be rolled, in other words in a direction parallel to the axis of rotation or axis of symmetry of the ring-shaped workpiece, while at the same time or consecutively, the ring is formed radially to the axis of rotation or axis of symmetry of the work piece or relative to its vertical axis, by way of the radial rolling roller. Frequently, a roll mandrel also interacts with the radial rolling roller.

In this connection, it is understood that the rolling rollers with their related roll shafts are generally put into motion or controlled rotationally, by way of corresponding radial drives or axial drives. Furthermore, such forming machines also comprise linear axles that are generally regulated hydraulically, as disclosed, for example, in DE 39 21 094 A1, and which serve for setting these rollers relative to one another, for example. Likewise, other modules, such as, for example, the intake guide, the roll mandrel or others can be controlled in corresponding hydraulically regulated manner, by way of corresponding linear axles. EP 2 444 176 B1 discloses hydrostatic drives, but these drives require very complex feed lines. On the other hand, DE 39 21 094 A1 and DE 38 24 856 A1 disclose electromechanical setting means.

SUMMARY OF THE INVENTION

It is an object of the present invention to make available a forming machine, particularly a ring-rolling machine, that works precisely while having a simple mechanical-engineering structure.

These and other objects are accomplished by a forming machine, particularly a ring-rolling machine, having the characteristics according to the invention. Further embodiments, which can also be advantageous independent of these characteristics, are found below.

In this connection, the invention proceeds from the fundamental recognition that in the case of ring-rolling machines, a simple mechanical-engineering structure, which nevertheless works precisely, can be guaranteed in that the hydraulically regulated linear axles or the drives of the roll shafts for the rolling rollers can be driven and controlled by means of direct drives.

The mechanical-engineering structure is simplified by means of the direct drives, particularly to the effect that it is possible to do without hydraulic control lines, which particularly must be guided to movable modules, if applicable, with significant effort, without control oil systems, and without corresponding servo valves.

Likewise, complicated gear mechanisms are eliminated. Instead, it is possible to use a system composed of servo pumps and servo motors as a drive, by means of the direct drives. In this connection, it has turned out that the corresponding advantages with regard to the hydraulically regulated linear axles are also advantageous, accordingly, in other forming machines.

It is understood that this fundamental recognition already demonstrates corresponding advantages when used with regard to only one drive, particularly if the corresponding drive is disposed on a movable module or disposed in relatively free-standing manner on the forming machine, which otherwise brings about corresponding long and failure-susceptible line paths. The advantages presented above are not only cumulative but also multiplicative, for example if all the drives are configured accordingly on one side or on a module of the ring-rolling machine; this property particularly holds true if all the drives for the hydraulically regulated linear axles and roll shafts of the ring-rolling machine are driven or controlled by means of direct drives.

In a specific implementation, a forming machine comprising at least one hydraulically regulated linear axle can be characterized in that the hydraulically regulated linear axle is driven by way of an electro-hydrostatic actuator. In this way, a forming machine that has a simple mechanical-engineering structure and nevertheless works precisely is made available.

The electro-hydrostatic actuator, also called an electro-hydrostatic direct drive, is generally characterized in that a conversion of electrical energy into a corresponding mechanical linear movement is carried out within a housing, by way of hydraulics. Instead of utilizing corresponding hydraulic lines, including possible control lines and servo valves, it is therefore possible—contrary to what is disclosed in EP 2 444 176 B1—to directly undertake electrical control of the hydraulically regulated linear axle.

Preferably, the forming machine has at least one hydraulically regulated linear axle, which is driven by way of an electro-hydrostatic actuator or by way of a drive other than an electro-hydrostatic actuator. In this connection, the advantages mentioned above already occur if only one of the hydraulically regulated axles is driven by way of an electro-hydrostatic actuator, while the other hydraulically regulated linear axles can still be driven conventionally. This result particularly holds true if the hydraulically regulated linear axle driven by way of the electro-hydrostatic actuator must be driven at a very remote location or in a moving module of the forming machine. The advantages multiply accordingly if multiple or all of the hydraulically regulated linear axles of the drives on a module, particularly a moving module, are driven by way of an electro-hydrostatic actuator. It is understood that accordingly, all of the hydraulically regulated linear axles can be driven by way of an electro-hydrostatic actuator, in each instance, which maximizes the advantages accordingly.

In this connection, it is understood that the corresponding advantages of an electro-hydrostatic actuator can be used to corresponding advantage in all forming machines having hydraulically regulated linear axles. In particular, forges, particularly radial forges, propelling machines, press-in machines, rolling machines, extruders, folding machines, deep-drawing machines, corrugating machines, crimping machines, straightening machines, bending machines, stretching machines, and compression machines can accordingly be provided with electro-hydrostatic actuators for hydraulically regulated linear axles, to corresponding advantage. Rolling machines or presses can be organized accordingly, in particularly advantageous manner. This attribute particularly holds true accordingly for ring-rolling machines.

Likewise, a ring-rolling machine comprising at least one radial drive, which is connected to interact with a roll shaft of a radial rolling roller that acts in the radial direction, and at least one axial drive, which is connected to interact with a roll shaft of an axial rolling roller that acts in the axial direction, can be characterized in that the radial drive and/or the axial drive comprise a motor having high torque, which is connected to interact with the related roll shaft without a gear mechanism, in order to nevertheless work precisely with a simple mechanical-engineering structure. A motor having high torque is particularly a motor that is able to replace the usual motor/gear mechanism combinations, so that the use of a gear mechanism is superfluous. In particular, a motor having high torque can be a slow-running motor having high torque, with the goal of doing without a gear mechanism. As the result of eliminating gear mechanisms, the respective radial and/or axial drives can also be referred to as direct drives.

The corresponding motor having high torque can particularly be a servo motor having a hollow shaft and/or a brushless direct-current motor. In particular, the corresponding motor having high torque may be a switched reluctance motor or a torque motor. The motor having high torque can be configured both as an external rotor and as an internal rotor, in other words as a motor having a conventional drive shaft. Sufficiently high torque can nevertheless be applied particularly by a torque motor, which can particularly be configured as high-pole direct drives from the group of slow runners and can deliver very high torque at relatively low speeds of rotation, with simple mechanical-engineering effort, particularly doing without a gear mechanism, so that precise work in the rolls driven by way of the torque motor can be guaranteed. Depending on the concrete implementation, in particular, an electromechanical motor, which accordingly also includes switched reluctance motors or torque motors or brushless direct-current motors, can advantageously be used as a motor having high torque, because here, too, a simple mechanical-engineering structure that allows precise work can be guaranteed, particularly doing without hydraulic control lines and the like. Corresponding advantages also occur when using electro-hydrostatic actuators at this location, if sufficient torque is available.

In particular, all of the driven radial rolls and axial rolls can be driven by way of the corresponding motor having high torque.

In a preferred embodiment, the radial rolling roller can comprise two roll shafts that are coaxially disposed and, if applicable, also configured in one piece, of which a first of the two roll shafts faces upward and a second of the two roll shafts faces downward, and on which a radial drive is provided, in each instance. This arrangement particularly makes it possible to apply a correspondingly higher torque. Cumulatively or alternatively, a lower moment stress on the roll shafts both in a radial aspect and in the circumference direction of the roll shafts is guaranteed in this way. In this regard, correspondingly coaxially disposed roll shafts, which serve to drive a radial rolling roller in a ring-rolling machine, comprising at least one radial drive, which is connected to interact with a roll shaft of a radial rolling roller that acts in the radial direction, and at least one axial drive, which is connected to interact with a roll shaft of an axial rolling roller that acts in the axial direction, are correspondingly advantageous.

In an embodiment, the ring-rolling machine has multiple radial drives and/or multiple axial drives, and at least one of the radial and axial drives comprises a drive other than a motor having high torque, which is connected to interact with the related roll shaft without a gear mechanism. It is true that this arrangement results in greater effort, but such arrangement can be advantageous under certain circumstances, for example if the corresponding drive must apply particularly high torques, or if other general conditions, such as, for example, a required overload protection, can be implemented more advantageously with a gear mechanism. It is understood that consideration can easily take place in this regard, and in order to implement the advantages mentioned above, at least one of the radial or axial drives can comprise a motor having high torque, which is connected to interact with the related roll shaft without a gear mechanism. On the other hand, it is understood that if applicable, all of the radial drives and/or all of the axial drives, particularly also all of the radial and axial drives, of the ring-rolling machine can comprise a motor having high torque, which is connected to interact with the related roll shaft without a gear mechanism, in order to thereby be able to implement a maximum of the advantages explained above.

It is understood that the characteristics of the solutions described above and in the claims can also be combined, if applicable, in order to be able to implement the advantages cumulatively, accordingly.

BRIEF DESCRIPTION OF THE DRAWINGS

Further advantages, goals, and properties of the present invention will be explained using the following description of an exemplary embodiment, which is also particularly shown in the attached drawing. In the drawing, the sole FIGURE shows a schematic side view of a ring-rolling machine.

DETAILED DESCRIPTION OF PREFERRED EMBODIMENTS

The ring-rolling machine 4 shown in the FIGURE, structured as a forming machine 1, comprises multiple hydraulically regulated linear axles 2, which are controlled, in each instance, by way of electro-hydrostatic actuators 3, as well as radial drives 5, 6 and axial drives 7, 8, which drive corresponding radial rolling rollers 10 and upper and lower axial rolling rollers 11, 12 by way of their roll shafts 9, in each instance.

In known manner, the ring-rolling machine 4 comprises a radial roll stand 15, on which a mandrel lifting apparatus 16 is radially displaceable by way of an upper drawing frame 17, wherein the mandrel lifting apparatus 16 in turn can axially displace the mandrel, which is not shown for the sake of clarity. Likewise, a lower drawing frame 18 is provided for further modules. For example, the ring-rolling machine 4 shown in the FIGURE also has an intake-side centering unit 19 as well as a radially displaceable axial roll stand 14, which carries the two axial rolling rollers 11 and 12, and an axially displaceable pusher 20, by means of which the upper axial rolling roller 11 of the two axial rolling rollers 11, 12 can be axially set. All of these movement possibilities are controlled by way of hydraulically regulated linear axles 2, by means of electro-hydrostatic actuators 3, in this exemplary embodiment.

The radial drives 5, 6 and axial drives 7, 8 are structured as torque motors, in each instance, and are connected to interact with the related roll shafts 9 without a gear mechanism. In this connection, the upper and lower roll shafts 9 of the radial drives 5, 6, which are each connected with the radial rolling roller 10, are configured in one piece in this exemplary embodiment, wherein in an alternative embodiment, they can also be disposed in multiple pieces but coaxially, one under the other, and can be connected with the radial rolling roller 10 directly or indirectly, in each instance.

Therefore the forming machine 1 relies on direct drives and thereby guarantees a simple mechanical-engineering structure, without the precision suffering as a result. In particular, it is also possible to do without complex hydraulic systems, which also have to be transferred to moving modules and therefore require great line effort.

Hydraulic oil tanks 22 for the related electro-hydrostatic actuators 3 are merely numbered as examples. These oil tanks 22 are preferably disposed on locally fixed modules with regard to the electro-hydrostatic actuators 3 to which they deliver the oil, in each instance, so that here, too, it is possible to do without movable hydraulic lines. Preferably, the oil tanks 22 are integrated into the electro-hydrostatic actuators 3. It is understood that such an arrangement of the oil tanks 22 on modules that are locally fixed with regard to the electro-hydrostatic actuators 3 or the integration of the oil tanks 22 into electro-hydrostatic actuators 3 or their housings is advantageous even independent of the other characteristics of the present invention, in a forming machine 1 having hydraulically regulated linear axles 2, even if electro-hydrostatic actuators 3 are not necessarily used, but rather other actuators that use hydraulic fluid are used.

Thus, although at least one embodiment of the present invention has been shown and described, it is to be understood that many changes and modifications may be made thereunto without departing from the spirit and scope of the invention.

What is claimed is:

1. A forming machine comprising:

(a) a radial roll stand carrying radial rolling rollers;

(b) a radially displaceable mandrel lifting apparatus disposed on said radial roll stand being radially displaceable with respect to said radial roll stand by way of a drawing frame;

(c) an axial roll stand carrying axial rolling rollers;

(d) at least one hydraulically regulated linear axle regulated via an electro-hydrostatic actuator;

(e) a control electrically coupled to said electro-hydrostatic actuator;

(f) an electro-hydrostatic direct drive comprising a housing and hydraulics disposed within said housing, said electro-hydrostatic drive comprising the electro-hydrostatic actuator, wherein the at least one hydraulically regulated linear axle is coupled to the electro-hydrostatic actuator, and the electro-hydrostatic actuator controls a movement of the at least one hydraulically regulated linear axle; and (g) a hydraulic oil tank coupled to the electro-hydrostatic actuator.

2. The forming machine according to claim 1, further comprising a further drive and at least one further hydraulically regulated linear axle.

3. The forming machine according to claim 2, wherein the further drive comprises the at least one further hydraulically regulated linear axle.

4. The forming machine according to claim 1, wherein the forming machine is a rolling machine.

5. The forming machine according to claim 1, wherein the forming machine is a forging machine.

6. The forming machine according to claim 5, wherein the forming machine is a radial forging machine.

7. The forming machine according to claim 4, wherein the rolling machine is a ring-rolling machine.

* * * * *